United States Patent [19]

Breneman

[11] 4,043,075

[45] Aug. 23, 1977

[54] TOY VEHICLE WITH GRIPPING TONGS

[75] Inventor: Jack L. Breneman, Orchard Park, N.Y.

[73] Assignee: The Quaker Oats Company, Chicago, Ill.

[21] Appl. No.: 654,924

[22] Filed: Feb. 3, 1976

[51] Int. Cl.[2] ..... A63H 27/12

[52] U.S. Cl. ..... 46/202; 46/40; 46/75

[58] Field of Search ..... 46/40, 75, 202, 216, 46/218

[56] References Cited

U.S. PATENT DOCUMENTS

| | | | |
|---|---|---|---|
| 2,751,712 | 6/1956 | Klint | 46/40 |
| 3,199,249 | 8/1965 | Carver et al. | 46/265 |
| 3,844,061 | 10/1974 | Goldfarb et al. | 46/40 |

*Primary Examiner*—Russell R. Kinsey
*Assistant Examiner*—Robert F. Cutting
*Attorney, Agent, or Firm*—Cumpston & Shaw

[57] ABSTRACT

A toy vehicle has a pair of gripping tongs spring-biased open and loosely housed in a recess preferably in the underside of a housing for the toy vehicle. A pair of spaced-apart cam surfaces are located in the recess for engaging the tong arms on opposite sides of their pivot, and a manually operable lever engages and moves the pivot deeper into the recess so the cam surfaces pivot the free ends of the tong arms together against the spring bias. The cam surfaces are preferably closer to the pivot than to the free ends of the tong arms, and the tong arms preferably have shoulders slidably engaging the cam surfaces during opening and closing movements.

10 Claims, 5 Drawing Figures

TOY VEHICLE WITH GRIPPING TONGS

BACKGROUND OF THE INVENTION

Workers in the toy art are continually seeking novel mechanism and toy simulations of real devices. Toys generally seek interest or amusement and cooperation between toy movements and manipulations of the toy user. In addition, toys must be safe, rugged, and durable, as well as esthetically attractive.

The invention occurred as a toy simulation of the functions of a real vehicle, and the invention aims at satisfaction of the objects mentioned above to provide a serviceable and ecomomical toy mechanism stimulating the interest of the user.

SUMMARY OF THE INVENTION

The inventive toy vehicle has a pair of gripping tongs for grasping and moving objects. It was originally developed as a simulation of a rescue helicopter able to grasp and lift objects, but it can be applied to other toy vehicles. The invention involves ways that the tongs are structured and operated relative to a toy vehicle.

A pair of tong arms are movably connected together at a pivot, and a spring biases the free ends of the tong arms apart. The toy vehicle has a housing forming a recess receiving the tong arms, and a pair of spaced-apart cam surfaces are located in the recess for engaging the tong arms on opposite sides of the pivot. A lever is manually operated for engaging and moving the pivot deeper into the recess so the cam surfaces pivot the free ends of the tong arms together against the bias of the spring. The cam surfaces are preferably located closer to the pivot than to the free ends of the tong arms, and the tong arms preferably have shoulders slidably engaging the cam surfaces during closing and opening of the tong arms. The toy vehicle housing preferably has a stop abutment limiting movement of the lever so that the lever holds the tong arms in the recess in open position when the lever engages the stop abutment.

DRAWINGS

DETAILED DESCRIPTION

Toy vehicle 10 is a simulated helicopter provided with a pair of tongs 11 for grasping and lifting objects to simulate a rescue function. Tongs 11 are manually operable for opening and closing as explained more fully below so that toy 10 can be positioned over an object that is grasped by tongs 11 and carried off in play. Tongs 11 can also be applied to other toy vehicles such as lumber-lifting trucks, log loaders or toters, or for any other purpose. Also, tongs 11 can be made operable on the underside of a housing for toy vehicle 10 or at some other orientation on a toy vehicle.

Figure 1:
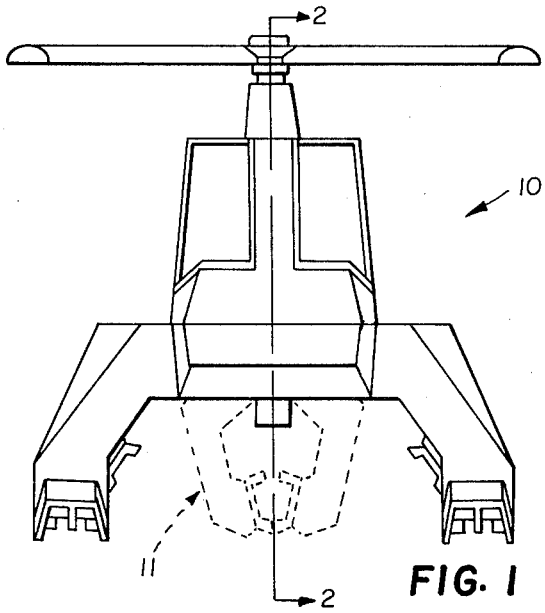
FIG. 1 is a front elevational view of one preferred embodiment of the inventive toy vehicle.
Figure 2:
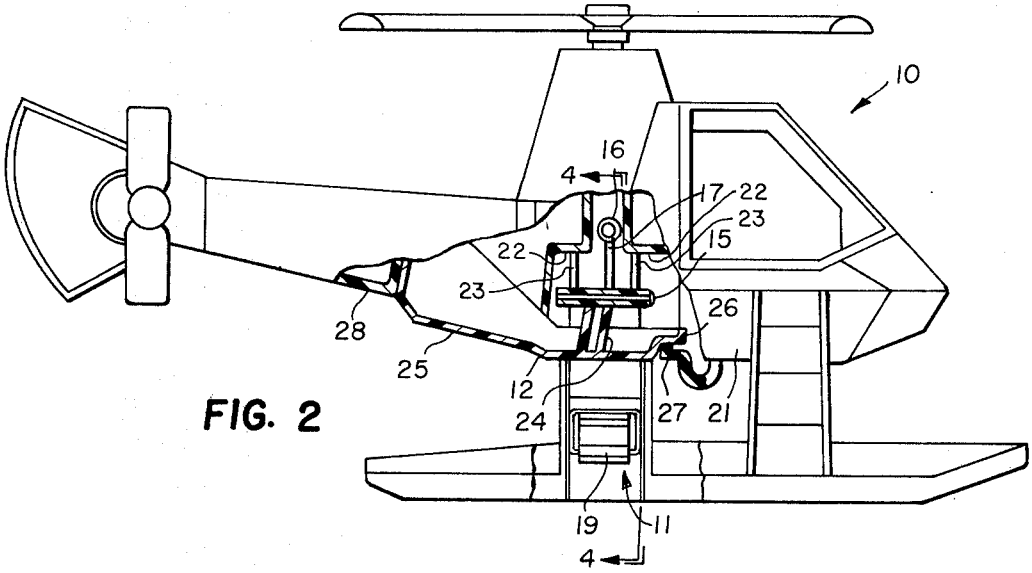
FIG. 2 is a partial longitudinal cross section of the vehicle of FIG. 1 taken along the line 2—2 thereof.
Figure 3:
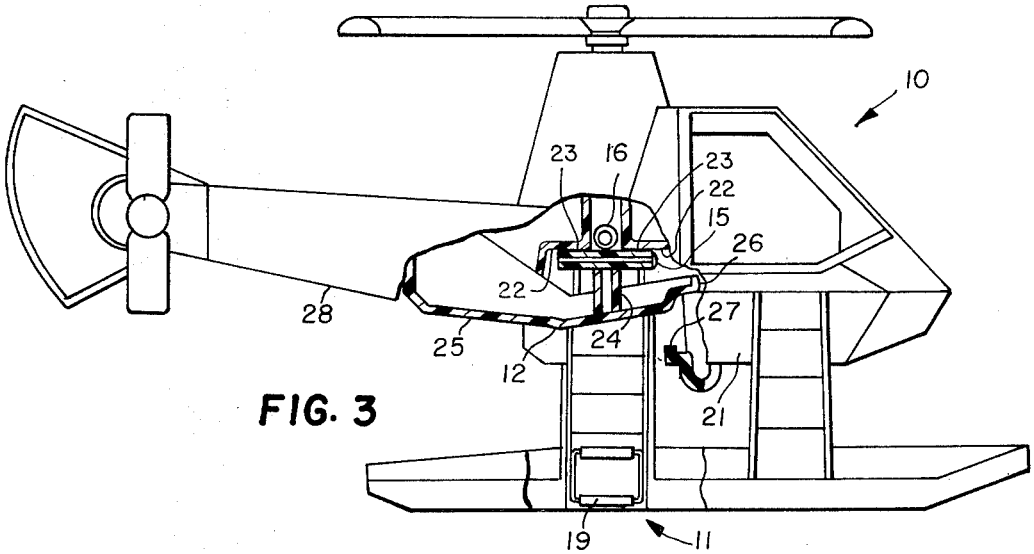
FIG. 3 is a cross-sectional view similar to the view of FIG. 2, but showing the operating lever for the tongs in raised position.
Figure 4:
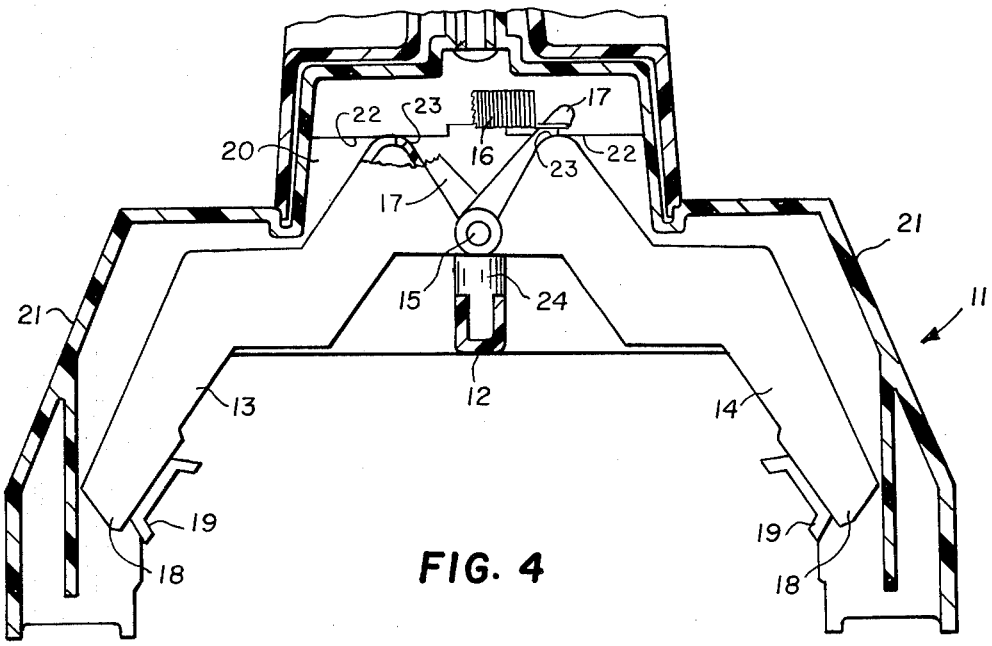
FIG. 4 is a fragmentary, cross-sectional view of the toy of FIG. 2 taken along the line 4—4 thereof.
Figure 5:
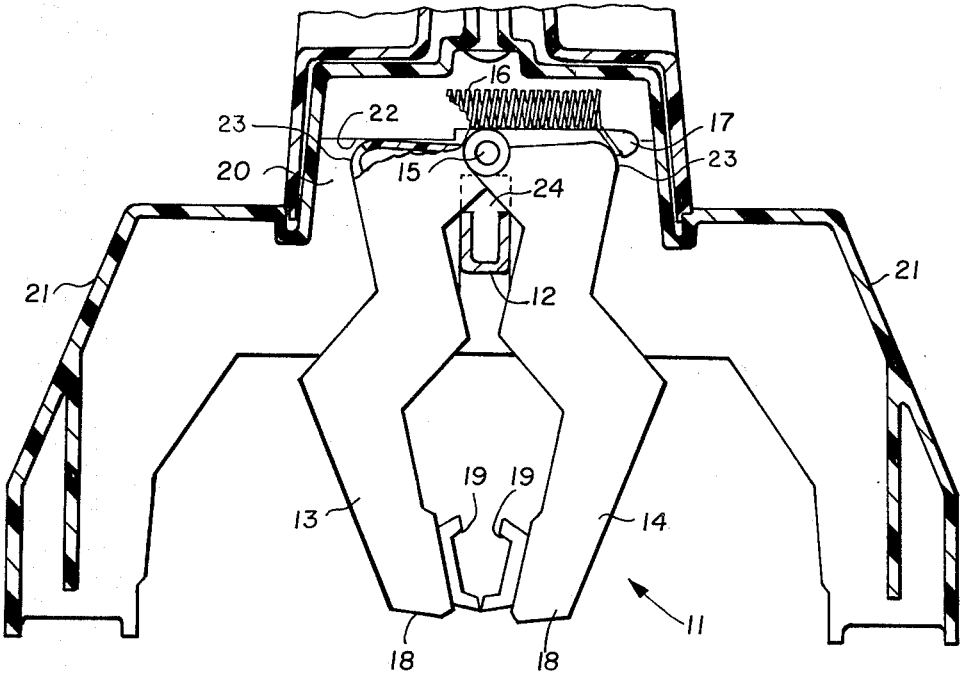
FIG. 5 is a fragmentary, cross-sectional view similar to the view of FIG. 4 but showing the tongs in closed position.

FIGS. 2 and 3 show the movement of a lever 12 that operates tongs 11, and FIGS. 4 and 5 show the mechanism for opening and closing tongs 11 in response to movement of lever 12.

Tongs 11 are formed of a pair of tong arms 13 and 14 joined together at a pivot 15 for pivoting between an open position as shown in FIG. 4 and a closed position as shown in FIG. 5. A spring 16 has its ends connected to a pair of hooks 17 formed on the tong arms above pivot 15 so that spring 16 biases the free ends 18 of the tong arms apart to the position shown in FIG. 4. Springs can be arranged in several ways to accomplish the same result, but one advantage of spring 16 is that it is nearly over center relative to pivot 15 when tongs 11 are closed as shown in FIG. 5 so that very little force is required to hold tongs 11 in the closed position. Gripping pads 19 are preferably arranged on the inside of the free ends 18 of the tong arms for engaging an object to be lifted when tongs 11 are closed.

The underside of the lower housing 21 of toy vehicle 10 is formed with a recess 20 that receives and houses at least the upper portion of tongs 11. In toy 10, recess 20 is formed for receiving substantially the entire tong arms 13 and 14 for substantially recessing tongs 11 out of the way when not in use. This is preferred for esthetic purposes, but is not essential to the invention. The upper portion of recess 20 surrounds pivot 15, spring 16, and the upper portions of tong arms 13 and 14 during operation.

A pair of fixed cam walls or surfaces 22 are formed in recess 20 on opposite sides of hooks 17 and spring 16 and on opposite sides of pivot 15 to engage respective pairs of rounded cam shoulders 23 on each side edge of tong arms 13 and 14. Lever 12 has a projection 24 that engages the underside of pivot 15 and a grip portion 25 that is engageable by fingers in a squeeze-grip fashion for raising and lowering lever 12 between the positions of FIGS. 2 and 3. When grip 25 is squeezed to raise lever 12 from the position of FIGS. 2 and 4 upward toward the position of FIGS. 3 and 5, projection 24 moves pivot 15 deeper into recess 20. As this occurs, pivot 15 moves upward relative to cam surfaces 22 so that each pair of shoulders 23 of tong arms 13 and 14 slide along surfaces 22 and thereby force tong arms 13 and 14 to pivot inward toward a closed position against the bias of spring 16. Gripping pads 19 then approach each other to grip opposite sides of an object, and tong arms 13 and 14 can be held in any intermediate position merely by squeezing grip 25. When grip 25 is released, lever 12 and projection 24 move downward under the bias of spring 16 which lowers pivot 15 and reopens tong arms 13 and 14. Cam surfaces 22 and tong arms 13 and 14 are preferably molded of resin material so that the sliding engagement of shoulders 23 against surfaces 22 occurs smoothly with relatively little friction and a long wear life.

Lever 12 is loosely mounted within an upper housing 28 for toy vehicle 10 and pivots freely between the positions of FIGS. 2 and 3. The forward end 26 of lever 12 engages a stop 27 formed on the underside of lower housing 21 to limit the lowermost position of lever 12 to the position of FIG. 2. This also limits the extent of downward movement of pivot 15 and serves to hold tongs 11 in recess 20 in open position. Tongs 11 are otherwise loosely housed in recess 20 and do not require any mechanical connection to toy 10 other than the support from projection 24 holding tongs 11 in place. This also facilitates assembly by allowing tongs 11 to be fitted loosely in recess 20, and held firmly in place by lever 12 housings 21 and 28 are secured together. Such an assembly and simple operating mechanism is not only rugged and durable, but relatively self cleaning when operated in sand boxes. The loose fit of tongs 11 in recess 20 and the loose fit of lever 12 in upper housing 28 keeps the moving parts freely operable in a simple and efficient way.

Persons skilled in the toy art will appreciate other ways of arranging and operating tongs for a toy vehicle, once the invention is clearly understood. Working parts can be made of different materials and configured in different ways to make other toy vehicles having a serviceable pair of gripping tongs.

I claim:

1. A toy vehicle having gripping tongs and comprising:

a. a pair of tong arms having free ends movable in one plane between a normal open position and a closed position;

b. a movable pivot connecting said tong arms for pivotal motion between said open and closed positions;

c. spring means for biasing said free ends of said tong arms apart into said normal open position in which said free ends can be positioned over an object;

d. said toy vehicle having a housing for supporting said tong arms;

e. at least one fixed cam surface located in said housing for engaging portions of said tong arms on opposite sides of said pivot; and f. a lever manually operable for engaging and moving said pivot relative to said housing causing said portions of said tong arms to engage said cam surface which pivots said free ends of said tong arms together into said closed position against the bias of said spring means for gripping the object.

2. The toy vehicle of claim 1 wherein said portion of said cam surfaces are located closer to said pivot than to the free ends of said tong arms.

3. The toy vehicle of claim 1 wherein said tong arms comprise shoulders slidably engaging said cam surfaces during closing and opening of said tong arms.

4. The toy vehicle of claim 1 wherein said spring means is a spring connected between said tong arms on the side of said pivot opposite said free ends of said tong arms.

5. The toy vehicle of claim 1 wherein said lever is pivotally mounted in said vehicle and is manually operated in a squeeze-grip fashion for moving said pivot.

6. The toy vehicle of claim 1 wherein said housing has a stop abutment limiting movement of said lever and said lever holds said tong arms in said housing in said normal open position when said lever engages said stop abutment.

7. The toy vehicle of claim 6 wherein said cam surfaces are located closer to said pivot than to the free ends of said tong arms.

8. The toy vehicle of claim 7 wherein said portions of said tong arms comprise shoulders slidably engaging said cam surfaces during closing and opening of said tong arms.

9. The toy vehicle of claim 8 wherein said lever is pivotally mounted in said vehicle and is manually operated in a squeeze-grip fashion for moving said pivot.

10. The toy vehicle of claim 9 wherein said spring means is a spring connected between said tong arms on the side of said pivot opposite said free ends of said tong arms.

* * * * *